United States Patent [19]

Gutierrez

[11] Patent Number: 4,483,466

[45] Date of Patent: Nov. 20, 1984

[54] APPARATUS FOR AUTOMATICALLY OPERATING THE DISCHARGE VALVE OF A PRESSURE CONTAINER

[76] Inventor: Arturo Martin Gutierrez, Doce de Octubre, 3.-Madrid, Spain, 9

[21] Appl. No.: 351,362

[22] Filed: Feb. 23, 1982

[30] Foreign Application Priority Data

Feb. 26, 1981 [ES] Spain ..... 256.473

[51] Int. Cl.[3] ..... G04C 23/48

[52] U.S. Cl. ..... 222/647; 222/649; 222/504; 222/509

[58] Field of Search ..... 222/638, 639, 644, 645, 222/646, 647, 649, 402.14, 402.15, 504, 509, 402.1, 505

[56] References Cited

U.S. PATENT DOCUMENTS

| | | | |
|---|---|---|---|
| 1,882,812 | 10/1932 | Gunn | 222/504 |
| 2,951,617 | 9/1960 | Brock | 222/644 |
| 2,967,643 | 1/1961 | Edelstein et al. | 222/509 |
| 3,018,056 | 1/1962 | Montgomery | 222/647 |
| 3,388,834 | 6/1968 | Hart | 222/649 |
| 3,647,116 | 3/1972 | Nixon, Jr. et al. | 222/647 |

*Primary Examiner*—Joseph J. Rolla
*Assistant Examiner*—George Pyryt

[57] ABSTRACT

An apparatus for automatically operating the discharge valve of a pressure container includes a drive shaft driven by an electric motor controlled by a timing device, the shaft being drivingly connected by a belt to a speed reduction unit having a plurality of intermeshing toothed wheels, the last of the toothed wheels having an eccentric which co-operates with a roller provided on one arm of a pivoted elbow lever. Such arm is connected to a spring which urges the lever towards a position where the free end of its other arm presses on the nozzle of a container to actuate such nozzle.

1 Claim, 1 Drawing Figure

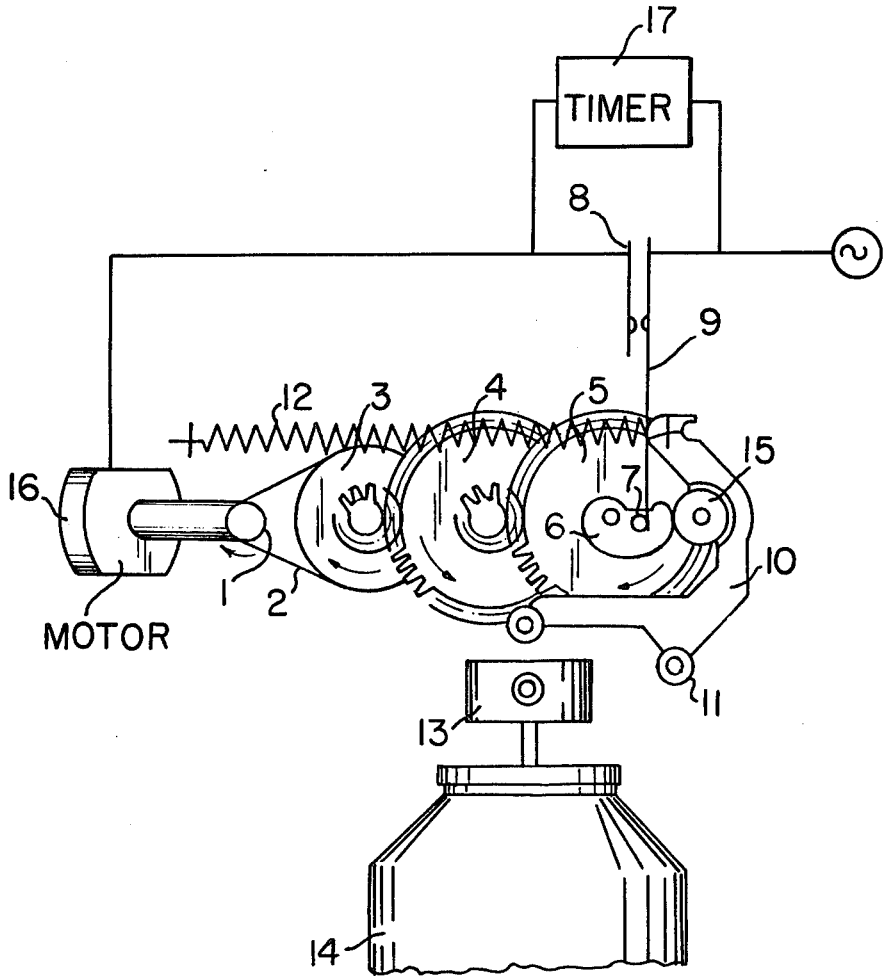
17
TIMER
8
9
12
3
4
5
15
16
7
6
10
1
2
MOTOR
11
13
14

APPARATUS FOR AUTOMATICALLY OPERATING THE DISCHARGE VALVE OF A PRESSURE CONTAINER

BACKGROUND OF THE INVENTION

This invention relates to an apparatus for automatically operating the discharge valve of a pressure container for dispensing liquid or vapour products contained in the pressure container.

Various types of apparatus designed to dispense certain products contained in pressure containers are commercially known. All these devices have as a common general characteristic the fact that they have an outer casing usually provided with a discharge hole through which the product is discharged and it is known to operate the nozzle of the container by means of an apparatus provided with a driving mechanism housed within the casing. These mechanisms consist of an electric motor usually fed with electrical current from batteries and means for transmitting the movement of the motor to a drive element for operating the dispensing nozzle of the container.

The devices actually in use present multiple disadvantages which, in some way, affect the operation of the devices, to the detriment of consumption, control and/or life of the apparatus itself. Thus, there is a wide range of devices which do not have any control media, whereby the use in the unit of different types of existing pressure containers poses a real problem, due to the different heights of the dispensing nozzles, consequently limiting their use only to certain types of containers.

Other known devices use, as a drive member for operating the nozzle a lever or cam, with a predetermined fixed throw which, due to the different heights of the dispensing nozzles, force the motors in the majority of cases to exert great efforts at the time product is dispensed, against the elasticity of the material itself, with a high electrical current consumption and the resulting premature exhaustation of the feed batteries.

SUMMARY OF THE INVENTION

According to the present invention there is provided an apparatus for automatically operating the discharge valve of a pressure container for automatically dispensing liquid or vapour products contained in the pressure container. The apparatus includes a drive shaft arranged to be driven by an electric motor controlled by a timing device, such shaft being drivingly connected to a speed reduction unit including a plurality of meshing toothed wheels, the last of the toothed wheels having connected thereto an eccentric which co-operates with a roller provided on one arm of a pivotable elbow lever, such one arm being connected to a spring which urges the lever towards a position where the free end of the other arm of the elbow lever presses on the discharge valve/-nozzle of the pressure container.

The apparatus of the present invention could be defined, with regard to existing apparatus, as one having an "inverse" operation, since in the known devices the pressure exerted on the dispensing nozzle of the container, whether by means of a cam or a lever, is carried out by the operation of the motor while this is taking place. However, in the device of the invention, the pressure is exerted by the recovery action of a spring on an appropriate lever, so that during the greater part of the operating cycle the basic function of the motor is to move the actuating lever to its starting position, progressively and counter to the action of the spring.

The unit has been formed starting from an appropriate motor from which movement is transmitted by means of an appropriate belt, preferably silicone to avoid noises, to a speed reducer set, formed by toothed wheels. The last toothed wheel has, conjunctively and integrally with its axle, an eccentric of suitable characteristics. The unit also has an elbow lever for actuation of the dispensing nozzle by one of its arms, the lever being capable of turning in relation to a mounting bearing, with an appropriate spring fitted to an opposite arm of the lever. Lastly, the eccentric is provided with an appropriate boss or pin for the operation of a current interruptor switch.

BRIEF DESCRIPTION OF THE DRAWINGS

An embodiment of the invention will now be described, by way of example, with reference to the accompanying drawing in which the single figure is an elevational view of the various elements of the apparatus according to the present invention.

DETAILED DESCRIPTION OF THE INVENTION

Referring to the drawing, the apparatus has a driving axle 1 which, by means of a belt 2 transmits movement to a speed reduction gear unit formed by toothed wheels 3, 4 and 5. The toothed wheel 5 has an axle provided with an eccentric cam 6 having a boss or pin 7 for the actuation of a switch formed by metallic fingers 8 and 9.

Adjacent to the toothed wheel 5 there is an elbow or L-shaped lever 10 which is rotatably mounted by a bearing 11 about which it can rotate. The upper end of the lever 10 is secured to a spring 2 with appropriate characteristics, the lower end of the lever 10 is free, and it is this end whch operates a dispensing nozzle 13 of a container 14 which contains the pressurized product that is to be dispensed. The spring 12 is secured at its opposite end to the frame (not shown) which contains the apparatus and container.

The lever 10 is provided with a roller 15, capable of rotating in relation to its mounting point, located in a position facing the eccentric 6.

In the interior of the frame will also be included other elements such as an electric motor 16 and a conventional-type timer device 17 which will transmit electrical current pulses to the motor and provided with means for time control that has to elapse between every two consecutive impulses.

Having described the various component parts of the apparatus of the invention, the operation thereof now will be described, starting from the rest position shown in the drawing. Thus, in the drawing the spring 12 is illustrated in its stretched position.

When the electric 16 receives an electrical impulse from the timer 17, the shaft 1 connected to its rotor is thereby rotated, transmitting this movement to the toothed wheel 3 by means of the belt 2 and from the toothed wheel 3 to the toothed wheel 5, by means of the toothed wheel 4. The eccentric 6 which is connected to the axle of the wheel 5, will change its position, whereby elbow lever 10 at this time will start moving, as the force of the spring 12 will urge it to rotate anticlockwise about the bearing 11, so that the lower free end of lever 10 will then apply pressure on the nozzle 13, forcing it downwards and thereby releasing the product contained in the container 14. Simultaneously, the boss or pin 7, in changing its position by moving with the eccentric 6, will have released the switching element 9, which then comes into contact with element 8, thereby maintaining the electric current supply to the electric motor 16 to maintain operation thereof.

When the eccentric 6 continues to rotate, it will cause the roller 15 to move back slowly and the lever 10 will move along with it, thus overcoming the tension of spring 12, so that when eccentric 6 has made one complete revolution and, therefore, completed one cycle, the apparatus will then be exactly in the same starting position shown in the drawing. The boss or pin 7, will make one full turn with the rotation of the eccentric 6, so that when the cycle has been completed, pin 7 again will come into contact with the switch element 9, moving it away from element 8, and thus cutting off the flow of electric current to the motor 16 and discontinuing the movement until a new impulse is generated by the timer 17.

The control of the quantity of the product to be dispensed for each operation will be determined by the internal control of the aerosol itself.

On the other hand, the height at which the free end of the elbow lever 10 is positioned permits its use with containers with different heights of their dispensing nozzles 13, within prescribed limits.

The apparatus thus formed is exceedingly simple, compact and noise-free during operation, and does not require any subsequent maintenance operation.

I claim:

1. An apparatus for operating automatically the discharge valve of a pressure container for dispensing therefrom liquid or vapor products, said apparatus comprising:

a shaft;

an electric motor operable for rotating said shaft about the axis thereof;

a speed reduction unit including a plurality of meshing gears;

belt means for transmitting rotation of said shaft to a first said gear, whereby meshing of said gears results in rotation of a last said gear at a speed slower than the rotation of said first gear;

an eccentric cam fixed to said last gear and rotatable therewith;

an L-shaped lever having a generally vertically extending first arm and a second arm extending generally horizontally from the lower end of said first arm, said lever being pivotally mounted about a pivot axis adjacent the juncture between said arms, and said first arm having rotatably mounted thereon a roller at a position to confront said cam;

spring means acting on the upper end of said first arm for urging said lever about said pivot axis in a direction to urge said roller into contact with said cam and to cause the free end of said second arm to move downwardly;

timer means, electrically connected to said motor, for transmitting thereto at predetermined time intervals electric current pulses, thereby for causing said shaft and said gears to rotate, and thereby for causing said cam to rotate from a start position, whereat said lever is maintained by said cam at an orientation with said free end of said second arm in a raised position adapted to be spaced above a discharge valve of a pressure container, to an actuating position, whereat said spring means pivots said lever about said pivot axis and moves said free end of said second arm downwardly to a position adapted to depress the discharge valve;

electric switch means, in an electric circuit for supplying current to said electric motor and including a movable element, for opening and closing said circuits; and pin means mounted on said cam at a position for contacting said element and opening said circuit when said cam is at said start position, for releasing said element and closing said circuit when said cam moves to said actuating position, and for contacting said element and again opening said circuit when said cam returns to said start position, thereby stopping operation of said motor until said timer means transmits another electric current pulse to said electric motor.

* * * * *